United States Patent [19]

Smith

[11] Patent Number: 4,747,224

[45] Date of Patent: May 31, 1988

[54] FIREARM MAGAZINE CATCH

[76] Inventor: David E. Smith, Rose Bank, 40 Berry Lane, Wootton, Northamptonshire NN4 0JX, England

[21] Appl. No.: 67,615

[22] Filed: Jun. 26, 1987

[30] Foreign Application Priority Data

Jun. 26, 1986 [GB] United Kingdom ..... 8615611

[51] Int. Cl.[4] ..... F41C 25/06

[52] U.S. Cl. ..... 42/7

[58] Field of Search ..... 42/7

[56] References Cited

U.S. PATENT DOCUMENTS

| | | | |
|---|---|---|---|
| 2,765,558 | 10/1956 | Roper et al. | 42/18 |
| 4,326,353 | 4/1982 | Ludwig et al. | 42/7 |
| 4,521,985 | 6/1985 | Smith et al. | 42/7 |
| 4,574,509 | 3/1986 | Smith | 42/7 |

FOREIGN PATENT DOCUMENTS

| | | |
|---|---|---|
| 1144622 | 2/1963 | Fed. Rep. of Germany . |
| 2905770 | 8/1980 | Fed. Rep. of Germany . |
| 358186 | 1/1906 | France . |
| 86/00400 | 1/1986 | PCT Int'l Appl. . |
| 667644 | 3/1952 | United Kingdom . |

*Primary Examiner*—Charles T. Jordan

*Attorney, Agent, or Firm*—Harness, Dickey & Pierce

[57] ABSTRACT

This invention relates to a firearm having an improved catch arrangement for retaining a magazine in a well in a grip portion of the firearm. A single spring (56) operates simultaneously pivotally to urge a catch member (18) into a magazine engaging position, to retain the catch member on a pivot and to urge outwardly catch release buttons (19 and 20) which can be depressed to engage inclined cam surfaces (18G and 18H) to cause retraction of the catch (18F) from a magazine detent engaging position.

9 Claims, 3 Drawing Sheets

FIREARM MAGAZINE CATCH

This invention relates to a fire arm having an improved magazine catch for retaining a magazine therein. Whilst applicable to other forms of firearm it is of particular use in firearms of the self loading pistol type, having a reciprocating breech block slide mounted on slide rails upon a frame which contains a barrel. Such firearms are adapted to have a cartridge box magazine held within the grip section of the frame and are provided with a suitable catch to retain and release the cartridge magazine from the grip portion of the frame.

It is an object of the present invention to provide a firearm with a cartridge magazine retaining catch that is operable from either side of the pistol with substantially equal pressure to release the cartridge magazine for removal from the firearm. The retaining and releasing catch of the present invention is of simple construction and cheap to manufacture and, as will be appreciated from the later detailed description, is such as not to require specialised tools to assemble or disassemble.

According to the present invention there is provided a fire arm comprising a frame provided with a grip portion having a space therein adapted to receive a cartridge magazine of the box type having detent means in a forwardly or rearwardly facing surface thereof, a catch member mounted for pivotal movement about an axis extending transversely of said frame for movement of a catch thereon into and away from a detent engaging position in which it is adapted to engage with the detent of a magazine when such magazine is received in said space, said catch member extending between two side walls of the frame which are pierced with opposite holes, a pair of release buttons, one in each hole, each having a flange at its inner end retaining it in its hole, the inner ends of the buttons engaging respective inclined cam surfaces on the catch member whereby upon pressing of either button into the frame the catch member will pivot to move the catch away from its detent engaging position, and a catch return spring comprising two legs engaging the frame joined by a bight portion, the bight portion engaging the catch member to urge the catch member to pivot towards its catch engaging position and the two legs also engaging respective ones of the buttons to urge them outwardly to project through the holes.

Preferably the catch member is pivotally mounted on a pin extending transversely of the frame and while the pivot catch member preferably is slotted to received the pivot pin it is possible, alternatively, to have the pin removably mounted in the frame, the pin passing through a hole in the catch member.

The preferred construction uses buttons of circular cross section which each have a chamfered flange extending around the entire periphery of their inner end as the retaining flange. These are particularly easy to mount in position and are of identical construction to simplify manufacture.

In a space saving format the catch member is elongated with two limbs extending respectively upwardly and downwardly from the pivot axis. The upper limb is engaged by the bight portion of the spring and the lower limb is provided with the catch and the inclined cam surfaces. The catch member thus extends substantially vertically and occupies little fore and aft space in the firearm frame.

Conventionally the magazine detent would be comprised by an aperture in the forwardly facing surface of the magazine with the catch member extending into a space in the frame immediately before the grip portion space.

The invention will be further described, by way of example, with reference to the accompanying drawings, in which.

Figure 1:
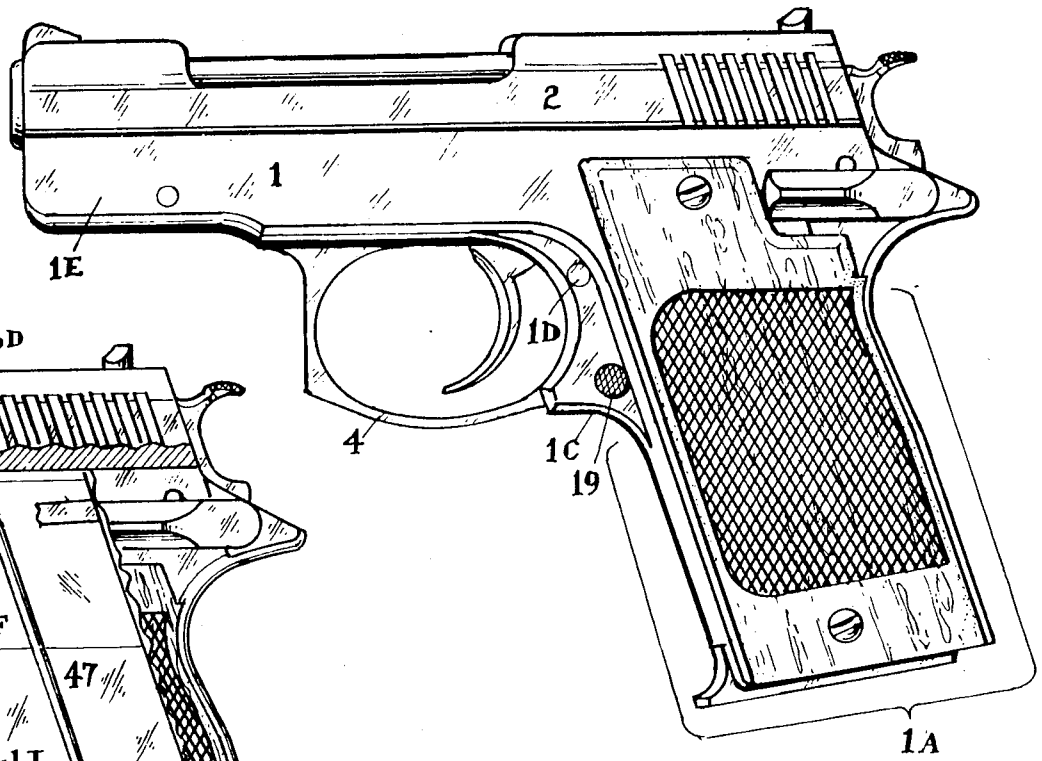
FIG. 1 is a left side elevational view of a self loading, semi-automatic pistol embodying the invention and having a cartridge magazine retaining and releasing catch.

FIG. 1 shows the pistol as comprising a frame 1 having a slide 2 mounted thereon. The frame has a grip portion or section 1A as a downward continuation of the frame rear section and the magazine is insertable into a grip section well or space from the bottom of the butt. The frame has its lower forward section 1C cut out to accomodate a trigger guard unit 4, the trigger guard unit having cutouts 4A which locate upon a transverse fame pin 1D, the trigger guard being thrust firmly upon pin 1D by a spring carried in the forward section 1E of the frame. The serrated outer end of the left magazine catch cam button 19 is visible in FIG. 1 at the lower rear of the trigger guard frame section.

Figure 3:
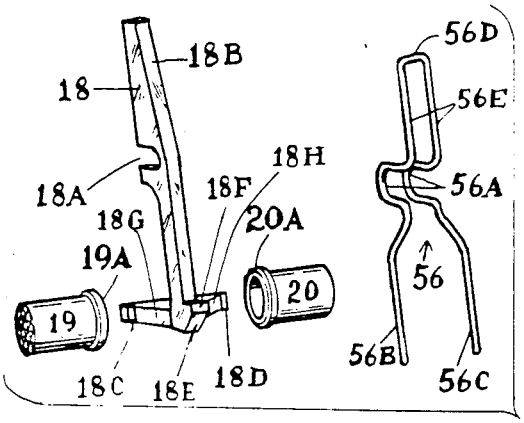
FIG. 3 is an exploded perspective view of the magazine catch, two identical magazine catch cam buttons and a magazine catch spring, all viewed from the rear left.
Figure 4:
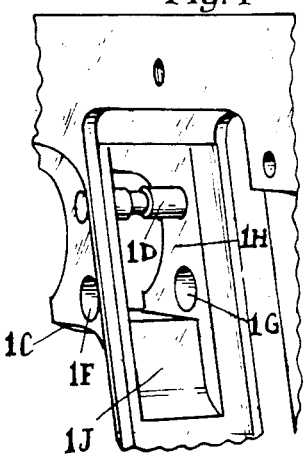
FIG. 4 is a partial perspective view of the pistol frame viewed from the rear left showing the frame interior.

As can be seen in FIG. 4 the frame pin 1D has its centre section rebated to have a smaller diameter and upon this smaller diameter section is mounted the magazine catch 18 by means of a cutout 18A shown in FIG. 3 which receives the centre section of the pin 1D. While this is the preferred construction for ease of assembly and disassembly it will be appreciated that if the pin 1D is made removable,instead of a slot 18A the catch member 18 can be provided with a through hole to receive the pin 1D.

The frame has two transverse holes 1F and 1G passing through the frame immediately behind the lower rear of the trigger guard when the trigger guard is installed. The holes 1F and 1G open into the cut out space 1H in the frame. Identical cam buttons 19 and 20 are inserted into the holes 1F and 1G. Each cam button has an inner flanged end 19A and 20A. The flanged ends are engageable with the inside of the frame to limit the extent to which the buttons can project to the outside of the frame.

As can be seen in FIG. 3 the magazine catch 18 is elongated and comprises an upwardly extending limb provided with a rearwardly facing surface 18B and a downwardly extending limb carrying, at its lower end, a catch or hook 18H provided with a downwardly facing cam surface 18E. The lower limb also is provided with oppositely facing inclined cam surfaces 18G and 18H to co-operate with the chamfered flanges 19A and 20A of the buttons 19 and 20 respectively. Magazine catch lugs 18C and 18D are provided at the ends of the cam surfaces for limiting movement of the catch into its magazine engaging position. The magazine catch spring 56 comprises two legs 56B and 56C joined by a transverse bight portion 56D. The upper portion 56E of the spring is connected via loops 56A with the free ends of the legs 56B and 56C.

The magazine catch spring 56 is assembled into the pistol with loops 56A around the frame pin 1D, each loop being adjacent to the sides of the magazine catch, and the limbs 56B and 56C pass down the front of the magazine well to rest against the frame shelf 1J, FIG. 4, which comprises a rear surface of the front of the grip portion of the frame. The top bight portion 56D of the magazine catch spring abuts against the surface 18B of the magazine catch and under torsion will pivot the magazine catch member around pin 1D. The magazine catch lugs 18D and 18C contact the periphery of the cam button flanges to prevent the magazine catch from protruding further than necessary into the frame magazine well.

Figure 2:
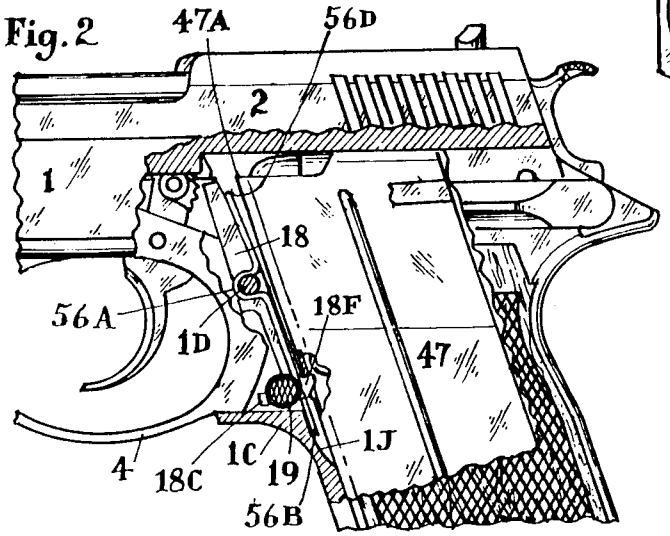
FIG. 2 is a partial view of the pistol, partly in elevation and partly in longitudinal vertical section, showing the magazine catch mounted on the pistol frame by means of a transverse pivot pin.
Figure 9:
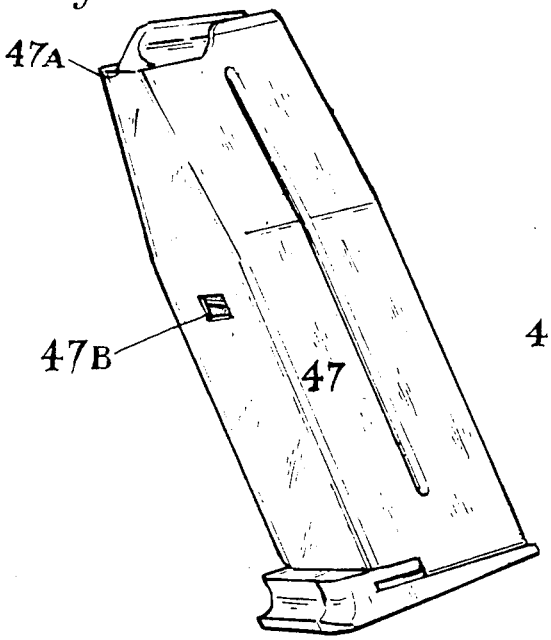
FIG. 9 is a perspective view of a magazine to be used in the pistol.
Figure 10:
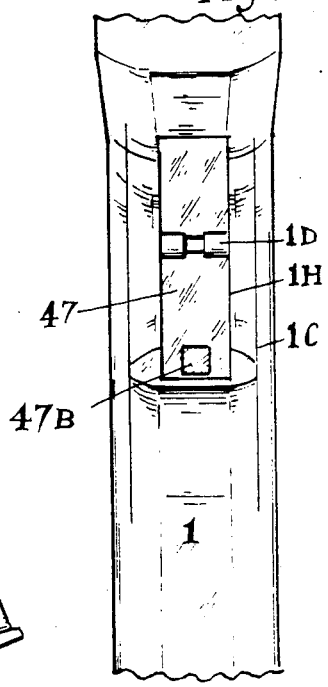
FIG. 10 is a partial perspective view of the pistol frame, viewed from the front, with the trigger guard and magazine catch removed to show the front of an inserted magazine.

Upon inserting the magazine into the frame magazine well, the magazine front lip 47A, FIG. 9, will impinge upon the magazine catch cam surface 18E to rotate the catch member against torsion of the upper portion 15E of the catch spring. When a detent comprised by a catch port 47B in the front of the magazine becomes adjacent the catch 18F, the catch will enter the catch port to retain a magazine in its fully inserted position, as shown in FIG. 2.

In order to release the magazine from the pistol, either cam button 19 or 20 can be pressed inwardly. The chamfered inner edge 19B or 20B of whichever, or both, cam buttons press on respective cam surface 18G and 18H to cam the magazine catch lower portion forwardly away from the magazine, against the spring torsion of the magazine catch spring, so that when the magazine catch is clear of the magazine catch port, the magazine can be removed downwardly from the grip portion of the pistol.

Figure 5:
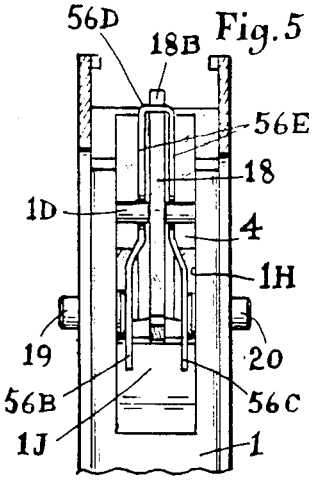
FIG. 5 is a partial view of the interior of the pistol viewed from the rear of the magazine well.
Figure 6:
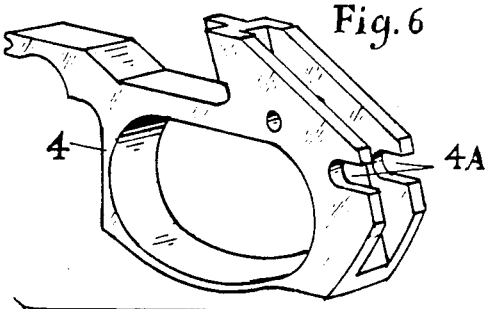
FIG. 6 is a perspective view of the trigger guard.
Figure 8:
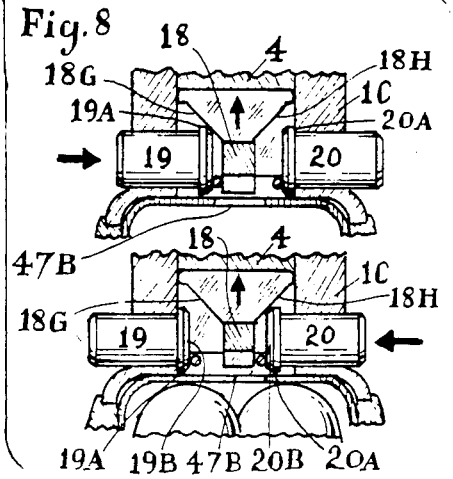
FIG. 8 shows partial longitudinal transverse sectional views taken along the centre line of the cam button holes, the upper view showing the action of the magazine catch when the left cam button is depressed and the lower view showing the action when the right cam button is depressed.

The action of the cam buttons is shown in FIG. 8. It will be seen that the magazine catch spring legs 56B and 56C urge outwardly away from each other under spring tension and abut against each cam button inner rim face, as shown in FIG. 5. FIG. 8 shows the left cam button being forced inwardly in the top illustration, and the right cam button being applied in the lower illustration. In both applications the respective left or right spring leg is forced inwards by the adjacent cam button and upon pressure being released from the outer surface via the cam button the respective spring leg will tend to force the adjacent cam button outwardly while the upper part of the magazine catch spring will force forward the top part of the magazine catch member to return the magazine catch to its rest, detent engaging, position.

Figure 7:
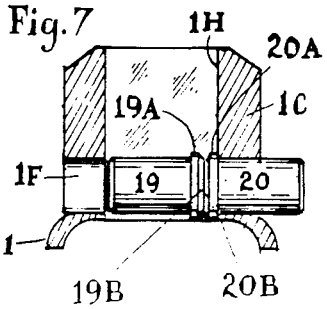
FIG. 7 is a partial longitudinal transverse sectional view taken along the centre line of the cam button receiving holes with the catch member and the magazine catch spring removed.

To disassemble the magazane catch assembly, the magazine catch spring is sprung off the frame pin and removed and the magazine catch can then be removed from the frame pin. The cam buttons are pushed into the frame cut out space 1H for removal. FIG. 7 shows the clearance in the frame cut out to allow removal of the cam buttons once the catch member has been removed.

While the invention has been described in connection with a semi-automatic pistol, it will be appreciated that it can be applied to other small arms and thus while, conveniently, the retaining spring and catch is shown as engaging the forwardly facing surface of the magazine 47, it will be appreciated that in alternative constructions it could be arranged to engage the rear surface although normally, especially in a pistol type construction, the present invention provides a particularly simple and space saving arrangement more suitably provided in front of the magazine receiving well space.

In general the terms top and bottom, left and right refer to the pistol when held in the hand normally by the grip with the pistol being viewed from the rear.

I claim:

1. A fire-arm comprising a frame provided with a grip portion having a space therein adapted to receive a cartridge magazine of the box type, said magazine having a forwardly facing surface and a rearwardly facing surface, one of said surfaces having detent means therein; a catch member mounted for pivotal movement about an axis extending transversely of said frame for movement of a catch thereon into and away from a detent engaging position in which it is adapted to engage with the detent of a magazine when such magazine is received in said space, said frame having two side walls between which said catch member extends, said side walls being pierced with opposite holes; a pair of release buttons, one in each hole, each said release button having inner and outer ends and having a flange at its inner end retaining it in its hole, said catch member having a pair of inclined cam surfaces thereon with the inner ends of the buttons engaging respective ones of said inclined cam surfaces whereby upon pressing of either button into the frame the catch member will pivot to move the catch away from its detent engaging position; and a catch return spring comprising two legs engaging the frame joined by a bight portion, the bight portion engaging the catch member to urge the catch member to pivot towards its catch engaging position and the two legs also engaging respective ones of the buttons to urge them outwardly to project through the holes.

2. A fire-arm according to claim 1, including a pin extending transversely of the frame, the catch member being pivotally mounted on said pin.

3. A fire-arm according to claim 2, wherein said pin has a reduced diameter central section of said pin upon which the catch member is mounted.

4. A fire-arm according to claim 2, wherein the catch member is provided with a slot in which the pivot pin is received.

5. A fire-arm according to claim 2, wherein the pin is removably mounted in the frame and passes through a hole in said catch member.

6. A fire-arm according to claim 1, wherein the buttons are of circular cross section and the retaining flange of each button is comprised by a chamfered flange extending around the entire periphery of the inner end of said button.

7. A fire-arm according to claim 1, wherein the catch member is elongated and has two limbs extending respectively upwardly and downwardly from the pivot axis, the upper limb being engaged by said bight portion of the spring and the lower limb being provided with said catch and said inclined cam surfaces.

8. A fire-arm according to claim 1, which is adapted to receive a magazine in which the detent is comprised by an aperture in the forwardly facing surface thereof, the catch member extending into a space in the frame immediately before the grip portion space.

9. A fire-arm according to claim 8, wherein the front of the grip portion of the frame has a rear surface, the legs of the spring engaging said rear surface.

* * * * *